United States Patent [19]

Iioka et al.

[11] Patent Number: 4,460,348

[45] Date of Patent: Jul. 17, 1984

[54] METHOD FOR PRODUCING A TWO-PIECE PAPER CONTAINER

[75] Inventors: Akira Iioka, Inzaimachi; Shoichi Suzuki, Tokyo, both of Japan

[73] Assignee: Nihon Dixie Company Limited, Tokyo, Japan

[21] Appl. No.: 270,091

[22] Filed: Jun. 3, 1981

[30] Foreign Application Priority Data

Jun. 9, 1980 [JP] Japan ..... 55-77448

[51] Int. Cl.[3] ..... B31B 1/64

[52] U.S. Cl. ..... 493/108; 156/218; 493/102; 493/133; 493/341

[58] Field of Search ..... 156/218, 217, 308.2, 156/308.4, 256; 162/146, 224, 228; 493/108, 109, 133, 134, 394, 104, 102, 341

[56] References Cited

U.S. PATENT DOCUMENTS 4,072,549 2/1978 Amberg et al. ..... 493/109 X
4,121,402 10/1978 Cress et al. ..... 156/256 X
4,132,591 1/1979 Merges, Jr. ..... 162/224 X
4,349,400 9/1982 Gilden ..... 493/109 X

OTHER PUBLICATIONS

"SWP Synthetic Fiber" Bulletin from Mitsui Zellerbach K.K. Dec., 1977.
"SWP" Bulletins from Crown Zellerbach, Sep., 1974.

*Primary Examiner*—James F. Coan
*Attorney, Agent, or Firm*—Oblon, Fisher, Spivak, McClelland & Maier

[57] ABSTRACT

A method for producing two-piece paper containers having waterproofness, water repellency, permeability and good stiffness without using any adhesive. A container body wall member and a container bottom panel member are blanked out from a base paper made from a stock containing about 10 to about 80% by weight of high-density polyethylene synthetic pulp. The blanked members are fabricated into a container using a conventional cup-making machine without using any adhesive. Then, the so-fabricated containers are heated at a temperature between about 120° C. and about 300° C. for a short period of time.

4 Claims, No Drawings

METHOD FOR PRODUCING A TWO-PIECE PAPER CONTAINER

BACKGROUND OF THE INVENTION

This invention relates to a method for producing two-piece paper cups or cup-like paper containers. More particularly, this invention relates to a method for producing paper containers using a base paper made of a stock containing high-density polyethylene synthetic pulp.

The conventional base paper for paper containers have been made of a stock mainly consisting of wood pulp. A container body wall member and a container bottom panel member are blanked out from this base paper and they are fabricated into a container using a conventional cup-making machine. In a method for producing paper containers using the conventional base paper, a cylindrical container body wall member must be formed by applying a suitable adhesive onto one end of the body blank in an axial direction. Also, the container body wall and bottom panel are adhesively joined. In addition, depending on their application, the containers have to be coated with wax or laminated with a polyethylene film. Moreover, the conventional paper containers have low stiffness, so there has been a limit to the size of the containers that can be fabricated.

Therefore, it is an object of this invention to provide a method for manufacturing paper containers which need no wax coating or lamination with a synthetic resin film, have high stiffness and which can be fabricated without using any adhesive.

This and other objects and advantages of the invention will appear as the description proceeds.

SUMMARY OF THE INVENTION

According to the present invention, there is provided a method for manufacturing paper containers which comprises blanking a paper container body wall member and a paper container bottom panel member from a base paper made from a stock containing about 10 to about 80% by weight of high density polyethylene synthetic pulp, fabricating the members into a container using a conventional cup-making machine, and heating the so-fabricated container at a temperature ranging from about 120° C. to about 300° C.

The high density polyethylene synthetic pulp which is used in the present invention is obtained by making high-density polyethylene hydrophilic by means of a special technique.

The high-density polyethylene synthetic pulp which is used in the present invention is sold by Mitsui Zellerbach Co., Ltd., 2-5, Kasumigaseki 3-chome, Chiyoda-ku, Tokyo 100, Japan under the registered trade name of SWP.

According to the brochure of SWP® published by Mitsui Zellerbach Co., Ltd., SWP® has the following characteristics: (i) heat sealability, (ii) waterproof and water repellency, (iii) controllable porosity and (iv) stiffness (after heat treatment). We obtained a base paper having high waterproofness, water repellency and permeability by heating a paper containing SWP® under atmospheric pressure. Then, we blanked out a container body wall member and a container bottom panel member from said base paper and tried to fabricate a container by heat-sealing the opposite cut ends of the body wall blank into in slight overlapping relationship. However, the overlapping cut ends could not be heat-sealed. Upon continuing the experiments and trials, we unexpectedly found that all the properties of SWP® can be attained by heating the fabricated container rather than heating the base paper before blanking out container members. That is, we found that a container body wall member and a container bottom panel member blanked out from a SWP®-containing base paper can be securely and integrally joined along slightly overlapping lateral ends by heating them under pressure so as to form a side seam but without using any adhesive. The so-fabricated container is then heated to give high waterproofness, water repellency, permeability and stiffness. The brochure of SWP® mentioned above does not teach or suggest the order of the container making steps specified by the present invention.

When the amount of SWP® used is less than 10% by weight, most of the inherent properties of SWP® are lost from the finished product. If the amount is more than 80% by weight, the resulting container becomes very sticky and difficult to handle after heating. The paper constituting the container becomes as if it were a plastic sheet whose molding property and stiffness is reduced.

The amount of SWP® used may vary over a wide range depending on the application of the finished containers (e.g. drinking cup, flower cup and cooking container), the size of the container and the desired properties (e.g. heat sealability, waterproofness, water repellency, permeability and stiffness).

According to the brochure published by Mitsui Zellerbach Co., Ltd., in order to obtain good heatsealability, SWP® must be used in an amount of more than 30% by weight, preferably more than 40% by weight. The base paper for manufacturing paper containers can be made of a single layer containing 30 wt% by weight of SWP®. In an alternative embodiment, the base paper has a multi-layer structure comprising one or more layers consisting of only wood pulp and one or more intermediate layers containing at least 30 wt%, preferably at least 40 wt%, of SWP®. A layer containing at least 30 wt%, preferably at least 40 wt%, of SWP® may be formed on one or both sides of the layer consisting of only wood pulp. The overall content of SWP® in the resulting multi-layer base paper is less than 30 wt%, but a desired container can be produced by heat-sealing if a layer containing at least 30 wt% of SWP® is formed on either of the surfaces of the paper layer.

As used in the above disclosure and through the specification and claims, the term "stock" means a mixture of wood pulp and a high density polyethylene synthetic pulp which optionally contains conventional additives such as strength modifier, sizing agent, waterproofing agent, greaseproofing agent, pigments, dyes, alum and the like. Therefore, the amount of SWP® defined above is based on the total weight of wood pulp, SWP® and the conventional additives (if any).

The paper containers fabricated from the SWP®-containing paper are then heated. The temperature for this heat treatment generally ranges from about 120° C. to about 300° C. The period for this heat treatment generally ranges from about 10 seconds to about 10 minutes. The lower the temperature, the longer the period. The higher the temperature, the shorter the period. The temperature for the heat treatment varies depending on factors such as the amount of SWP® in the base paper, the size of the container, the thickness of the paper, the degree of the properties desired, and the heating means. If the specific application, size, properties desired and the like are determined, the optimum temperature for the heat treatment may be determined with ease. The period for the heat treatment also generally varies depending on the factors mentioned above.

The temperature for the heat treatment must be higher than about 120° C. At a lower temperature, SWP® in the base paper does not melt and the inherent properties of SWP® are not exhibited. Generally, paper begins to scorch at a temperature higher than 200° C., but if the period of time for the heat treatment is short, containers can be heated without scorching at a temperature higher than 200° C. The upper limit of the temperature is determined by correlation with the heating period on the condition that the SWP® in the base paper is melted without scorching the paper. Generally, the upper limit of the temperature is about 300° C.

The heat treatment can be carried out under atmospheric pressure. It can be accomplished by means of a hot-air heater. Also, the heat treatment can be performed by heating the fabricated containers in an oven or passing them through a tunnel equipped with a heating means such as infrared rays or heating wire.

Prior to blanking, the SWP®-containing base paper may be slightly heated to the extent that its heat sealability is not impaired. The stiffness of the base paper so treated is a little higher than that of a base paper which is not heated at all, so the mouth rim of the container fabricated from this base paper has good curing property.

The method of the present invention comprising fabricating containers from an SWP®-containing paper and then heating the so-fabricated paper containers is superior to the prior art process for manufacturing paper containers in various points. For example, in the prior art process for preparing paper containers for cold drinks, the wax coating step is indispensable, but according to the process of the present invention, this step using expensive wax can be eliminated, so one can prepare paper containers at low cost. Also, according to the process of the present invention, there will be no environmental pollution due to melted wax. In addition, the user is entirely free from the risk of melting the wax by accidentally pouring hot liquid into the container. Similarly, in the prior art process for producing paper containers for hot drinks, the interior wall is coated or lined with a synthetic waterproofing resin film such as polethylene film, but in the process of the present invention, the coating or lining step is not necessary at all. In order to make large size paper containers having high stiffness by the prior art process, the thickness of the base paper must be increased which results in high manufacturing cost. According to the process of the present invention, one can cheaply prepare a large size paper container having high stiffness using a base paper having a relatively low thickness. Moreover, paper containers for flowerpots can be manufactured by the process of the present invention. The paper container manufactured by the process of the present invention is not only waterproof and water repellent but also gas permeable. The paper is impermeable to water drops but it is permeable to oxygen, air or water vapor, so there is no possibility that the roots of plants will rot. In addition, since the container has high stiffness, the container would not break even if the soil and plant are put into the container. Because of its light weight, the container is very easy to handle. The container manufactured by the process of the present invention can also be used for afforestation: the soil and a seedling are put into the container and it is buried in the ground of mountains. The SWP®-containing paper decomposes in the soil, so it is reduced to the soil in the long run. By utilizing its permeability and waterproofness, the product of the present invention can also be used as a container for making a steamed cake. During steaming, the cake does not become soggy by water drops on the surface in contact with the container as often found in plastic containers.

The present invention is further illustrated by reference to the following examples which are intended to be representative rather than restrictive of the scope of the present invention.

EXAMPLE 1

A base paper (200 g/m$^2$) was made from a stock comprising 50% by weight of wood pulp and 50% by weight of SWP®. A container body wall member and a container bottom panel member were blanked from the base paper. They were fabricated into a container using a conventional cup-making machine. The so-fabricated container was heated in an electric oven at a temperature in the range of 180° C. to 185° C. for two minutes. After heating, the container was removed from the oven and tested for stiffness, water absorption, stiffness after water absorption, and retention of stiffness. As a control, a container was fabricated in the same manner without heating and tested for the same factors. The test results are summarized in Table 1 below.

TABLE 1

| Factors | | Unheated (a) (Control) | Heated (b) (Example) | (b)/(a) |
|---|---|---|---|---|
| Stiffness (g/¼ inch distortion) | | 102 | 180 | 1.76 |
| Water absorption (%) | After one day | 45.0 | 9.3 | 0.21 |
| | After two days | 53.0 | 9.4 | 0.18 |
| Stiffness after water absorption (g/¼ inch distortion) | After one day | 45 | 158 | 3.51 |
| | After two days | 42 | 159 | 3.79 |
| Retention of stiffness (%) | After one day | 44.1 | 87.8 | 1.99 |
| | After two days | 41.1 | 88 | 2.14 |

EXAMPLE 2

A base paper (200 g/m$^2$) was made from a stock comprising 60% by weight of wood pulp and 40% by weight of SWP®. The base paper was slightly heated before blanking a container body wall member and a container bottom panel member. The members were fabricated into the container in the same manner as that noted in Example 1. The so-fabricated container was then heated in an electric oven at a temperature between 180° C. and 185° C. for two minutes. The heated container was tested for the same factors as those described in Example 1. As a control, a container was fabricated in the same manner without heating and tested for its performance. The test results are summarized in Table 2 below.

TABLE 2

| Factors | Unheated (a) (Control) | Heated (b) (Example) | (b)/(a) |
|---|---|---|---|
| Stiffness | 202 | 250 | 1.24 |

TABLE 2-continued

| Factors | | Unheated (a) (Control) | Heated (b) (Example) | (b)/(a) |
|---|---|---|---|---|
| (g/¼ inch distortion) | | | | |
| Water absorption (%) | After one day | 11.9 | 9.8 | 0.82 |
| | After two days | 11.4 | 9.7 | 0.85 |
| Stiffness after water absorption (g/¼ inch distortion) | After one day | 133 | 182 | 1.37 |
| | After two days | 125 | 174 | 1.39 |
| Retention of stiffness (%) | After one day | 65.8 | 72.8 | 1.11 |
| | After two days | 61.9 | 69.6 | 1.12 |

The figures for the control in this Example are better than those obtained in Example 1. This would be because in this example, the SWP®-containing base paper was slightly heated before blanking the container members.

What is claimed as new and desired to be secured by Letters Patent of the United States is:

1. A method for producing a two-piece container consisting of blanking a container body wall member and a container bottom panel member from a base paper made of a stock containing about 10 to about 80% by weight of high-density polyethylene synthetic pulp;

fabricating the members into a container using a conventional cup-making machine; and then increasing the water proofness, water-repellency or stiffness by heating the so-fabricated whole container at a temperature between 120° C. and about 300° C.

2. A method according to claim 1 wherein the members are fabricated into the container by only heat sealing without using any adhesive.

3. A method for producing a two-piece paper container which comprises:

heating a base paper to the extent that its heat-sealability is not impaired, said base paper being made of a stock containing about 10 to 80% by weight of high-density polyethylene synthetic pulp;

blanking a container body wall member and a container bottom panel member from the base paper;

fabricating the members into a container using a conventional cup-making machine; and then increasing the water-proofness, water-repellency or stiffness by heating the so-fabricated whole container at a temperature between about 120° C. and 300° C.

4. A method according to claim 3 wherein the members are fabricated into the container only by heat sealing without using any adhesive.

* * * * *